US011259676B2

(12) United States Patent
Eichberger et al.

(10) Patent No.: US 11,259,676 B2
(45) Date of Patent: Mar. 1, 2022

(54) VACUUM CLEANER DEVICE

(71) Applicant: SENSIRION AG, Stafa (CH)

(72) Inventors: Maximilian Eichberger, Stafa (CH); Bernd Zimmermann, Ashland, OH (US)

(73) Assignee: SENSIRION AG, Staefa Zh (CH)

( * ) Notice: Subject to any disclaimer, the term of this patent is extended or adjusted under 35 U.S.C. 154(b) by 690 days.

(21) Appl. No.: 16/116,959

(22) Filed: Aug. 30, 2018

(65) Prior Publication Data

US 2020/0069132 A1 Mar. 5, 2020

(51) Int. Cl.
*A47L 9/28* (2006.01)

(52) U.S. Cl.
CPC ..... *A47L 9/2826* (2013.01); *A47L 2201/06* (2013.01)

(58) Field of Classification Search
CPC ..... A47L 9/2826; A47L 2201/06
USPC ..... 73/25.01, 25.04, 29.01, 335.06
See application file for complete search history.

(56) References Cited

U.S. PATENT DOCUMENTS 6,571,421 B1 * 6/2003 Sham ..... A47L 5/28 15/320
10,010,231 B2 * 7/2018 Knutson ..... A47L 11/4036
2005/0188495 A1 * 9/2005 Takenaka ..... A47L 9/2805 15/319
2006/0130646 A1 6/2006 Seo et al.
2007/0234502 A1 * 10/2007 Brobeck ..... A47L 11/4041 15/319
2016/0066759 A1 3/2016 Langhammer et al.
2018/0317725 A1 * 11/2018 Lee ..... A47L 11/202
2018/0344114 A1 * 12/2018 Scholten ..... A47L 9/2894
2019/0365180 A1 * 12/2019 Miyamoto ..... A47L 9/2805
2020/0315421 A1 * 10/2020 Kung ..... G01N 21/55

FOREIGN PATENT DOCUMENTS

| | | | |
|---|---|---|---|
| CN | 101535788 | A | 9/2009 |
| CN | 104244792 | A | 12/2014 |
| CN | 107407935 | A | 11/2017 |
| CN | 108289585 | A | 7/2018 |
| JP | H1189771 | | 4/1999 |
| WO | 2008/007830 | | 1/2008 |
| WO | 2016133320 | | 8/2016 |
| WO | 2016173919 | | 11/2016 |
| WO | 2017141536 | | 8/2017 |

* cited by examiner

*Primary Examiner* — Bryan R Muller
(74) *Attorney, Agent, or Firm* — JMB Davis Ben-David

(57) ABSTRACT

The present invention relates to a vacuum cleaner device (1) for operation on a floor area (F), comprising: a suction duct (7) and an actuator (9) arranged and configured to generate an underpressure in the suction duct (7) so that air is sucked into the suction duct (7), a temperature sensor (10) configured to sample an air temperature in the vicinity of the device (1), wherein said temperature sensor (10) is arranged in the suction duct (7) or adjacent an opening (**6*d*) of the suction duct (7), and an analyzing unit (3**) configured to detect a wet spot (W) on said floor area (F) using said sampled air temperature.

20 Claims, 12 Drawing Sheets

VACUUM CLEANER DEVICE

TECHNICAL FIELD AND BACKGROUND

The present invention relates to a vacuum cleaner device. Such a vacuum cleaner device can be used, e.g. in a household, for vacuum cleaning, sweeping (wet-vac) etc.

During operation of such devices it is usually desirable to detect wet spots (e.g. liquid layers, e.g. due to a spilled liquid) on the floor area (e.g. a carpet or a hard floor) so that the device does not suck up the liquid (in case the vacuum cleaner device is not configured for removing liquids) or repeatedly moves over the wet spot. Further, in case a wet spot is detected, the owner/user can be alerted about the presence of liquids. Such features are especially useful for autonomous operation of robotic vacuum cleaner devices.

In the prior art it is known to use relative humidity sensors to determine wet spots (e.g. US2006130646A1) or to avoid double cleaning (e.g. WO2008/007830A1). Furthermore, the device disclosed in US2016066759A1 comprises a temperature sensor, but a specific use of the temperature sensor is not disclosed.

Regarding the use of relative humidity sensors it turns out that these sensors are rather difficult to apply to the task of detecting individual wet spots on a floor area on which the vacuum cleaner device operates, since such sensors are usually rather slow and can therefore be inaccurate in the detection of a wet spot. Also the durability of an relative humidity sensor can be limited since these sensors are usually prone to dust.

SUMMARY

The present invention improves on the contemporary art by disclosing a vacuum cleaner device configured to operate on a floor area (e.g. for removing, particularly collecting, dust and other small particles from said floor area), wherein the device comprises a suction duct and a temperature sensor for sampling an air temperature in the vicinity of the device (e.g. upon movement of the device on the floor area) as a function of time, wherein the temperature sensor is arranged in the suction duct or adjacent an opening of the suction duct. Further, the vacuum cleaner device comprises an analyzing unit configured to detect a wet spot on said floor area using said sampled air temperature as an input.

Particularly, when the temperature sensor is arranged adjacent an opening of the suction duct, the temperature sensor is arranged such with respect to the suction duct (or with respect to said opening of the suction duct) that a suction effect generated by the suction duct is present at the location of the temperature sensor.

Surprisingly, it turns out that a temperature sensor allows a very precise and reliable detection of wet spots. Furthermore, such a sensor can be more robust and less prone to contamination. Particularly, such a temperature sensor can be mounted on the device at a location where it is more shielded from mechanical damage. This allows improving reliability and durability of the device according to the present invention. Since a temperature sensor usually comprises a faster response time (e.g. 2 s when using e.g. STS3x of Sensirion AG, Staefa ZH, Switzerland) than a relative humidity sensor (e.g. 8 s when using e.g. SHTW2 of Sensirion AG), the device can move with a higher velocity on the floor area while still being able to detect wet spots.

Furthermore, it can also detect smaller amounts of liquids.

Particularly, the wet spot to be detected by the vacuum cleaner device can be formed by a spilled liquid (forming e.g. a liquid layer on said floor area). The liquid can e.g. be water or a spilled beverage, but also urine (e.g. pet or child urine). The floor area can be a carpet or another floor type (e.g. hard floor), but can also be a grass area in other embodiments of the device (e.g. in case the device is a lawn mower etc.).

The analyzing unit can be or can comprise an analyzing circuit (e.g. an integrated circuit) that is particularly adapted to detect the respective wet spot using the sampled temperature (and optionally relative humidity) or a computed slope of the sampled temperature or of the sampled relative humidity, wherein the slope of the sampled temperature is the derivative of the sampled temperature with respect to time.

Likewise, the slope of the sampled relative humidity is the derivative of the sampled relative humidity with respect to time. The analyzing unit can also be or comprise a computer or processor on which an algorithm (software) is executed that is adapted to detect the wet spot as described herein.

The vacuum cleaner device can be configured to be moved manually, but may also comprise a drive system (e.g. in case the device is a robotic vacuum cleaner device).

According to an embodiment, the vacuum cleaner device is a robotic vacuum cleaner device that is configured to autonomously operate on said floor area.

Further, in an embodiment, the robotic vacuum cleaner device comprises a drive system that is configured to move the device autonomously on said floor area.

Particularly, the drive system of the device can comprise rotatable wheels via which the device is supported on the floor area. At least one of the wheels can be driven by a motor of the drive system of the device. In an embodiment, a first wheel can be driven with a first motor and a second wheel with a second motor of the drive system. This also allows steering of the device in a simple manner. Other ways of steering and driving the device can also be used. For instance, alternatively (e.g. instead of wheels), the device can comprise continuous tracks for moving on the floor area or other elements for transferring a force generated by the motor(s) of the drive system of the vacuum cleaner device to the floor area.

Further, according to an embodiment of the present invention, the vacuum cleaner device is configured to measure and/or control a velocity of the vacuum cleaner device with respect to the floor area. This velocity can optionally be used to determine a size (e.g. a diameter) of a detected wet spot.

Particularly in case of larger velocities of the vacuum cleaner device with respect to the floor area, the slope of the sampled temperatures (or of the sampled relative humidity) can provide a more accurate detection signal. In case of smaller velocities of the vacuum cleaner device, the raw signal, i.e. the sampled temperature or sampled relative humidity, is preferably used according to an embodiment.

Further, in an embodiment, the device may comprise an electronic control unit to control the drive system, particularly the respective motor (e.g. the first and the second motor), so that the device can move autonomously on said floor area. The device may further comprise a navigation system for determining the current location (e.g. coordinates) of the device on the floor area (e.g. upon moving on said floor area), and particularly for passing the current location to the electronic control unit.

Further, in an embodiment, the analyzing unit is configured to detect the presence of a wet spot on the floor area in case the sampled air temperature shows a predefined temperature drop over a predefined period of time, or in case a slope of the sampled temperatures is negative and decreases below a predefined threshold.

Furthermore, according to an embodiment, the temperature drop per period of time is larger than 0.2° C./s. According to an embodiment, the temperature drop per period of time is in the range from 0.4° C./s to 1° C./s. Particularly, when approaching the wet spot, the slope will be negative, whereas when leaving the wet spot, it will be positive.

In the rare case, were a hot liquid is spilled on a colder floor and the vacuum cleaner device crosses this wet spot while the liquid is still hot, the T slopes may be inverted.

This case can be discriminated by performing an integrity check with the relative humidity sensor.

Furthermore, according to an embodiment, the integrity of the derived information may be checked by analysing the total temperature drop. Preferably, the total temperature drop is larger than 0.2° C., most preferably, larger than 0.5° C.

Further, according to an embodiment of the present invention, the analyzing unit is configured to determine a beginning and an end of a wet spot. Particularly, said beginning corresponds to a location on the floor area for which the analyzing unit determines an onset of a temperature drop of the sampled temperature or a negative slope of the sampled temperature, which slope is smaller than a predefined threshold, and wherein said end corresponds to a location on the floor area for which the analyzing unit determines an onset of an increase of the sampled temperature or a positive slope of the sampled temperature, which positive slope is larger than a predefined threshold.

The respective threshold is used to differentiate from noise and slower effects exhibiting a changing temperature (e.g. being near an open window or heat source, e.g. a radiator). Particularly, an upper limit is less important because it depends mainly on a response time of the sensor and a velocity of the vacuum cleaner device.

Particularly, for reducing a risk of detecting false positives, the analyzing unit is configured to at least one of:

- determine if the temperature drop is followed by an increase of the sampled temperature after passing of a pre-defined time span to confirm detection of the wet spot;
- determine if a relative humidity sampled by the vacuum cleaner device increases when the temperature drop occurs and/or decreases when said increase of the sampled temperature after passing of said pre-defined time span occurs to confirm detection of the wet spot;
- determine if a total temperature drop associated with the detected wet spot exceeds a pre-defined threshold to confirm detection of the wet spot;
- determine if a total relative humidity increase associated with to the detected wet spot exceeds a pre-defined threshold.

Particularly, said pre-defined time span corresponds to a given size (e.g. diameter) of a wet spot divided by the velocity of the vacuum cleaner device.

Further, according to an embodiment, the vacuum cleaner device comprises at least one relative humidity sensor for sampling a relative humidity of the air as a function of time in the vicinity of the vacuum cleaner device (e.g. upon movement of the device on the floor area).

Further, according to an embodiment, the analyzing unit is configured to detect a wet spot on said floor area using said sampled air temperature and said sampled relative humidity.

Further, according to an embodiment, the analyzing unit is configured to detect the presence of a wet spot on the floor area in case the sampled air temperature shows a predefined temperature drop over a predefined period of time (or a slope of the sampled temperature is negative and decreases below a predefined threshold) and the relative humidity shows a predefined increase over a predefined period of time (or a slope of the sampled relative humidity increases above a predefined threshold).

Further, according to an embodiment, the relative humidity (RH) increase per time unit is larger than 0.1% RH/s. Preferably, it is in the range from 0.2% RH/s to 0.5% RH/s.

Particularly, when approaching the wet spot, the slope of the sampled relative humidity will be positive. Furthermore, when leaving the wet spot, the slope of the sampled relative humidity will be negative. Once such a slope is detected, the integrity of the derived information can be checked by analysing the total relative humidity (RH) increase, which is particularly assumed to be larger than 0.3% RH, preferably larger than 0.5% RH, in case of a wet spot.

Further, according to an embodiment of the present invention, the analyzing unit is configured to determine a beginning and an end of a wet spot using the sampled relative humidity. Particularly, said beginning corresponds to a location on the floor area for which the analyzing unit determines an onset of an increase of the sampled relative humidity or a positive slope of the sampled relative humidity, which slope is larger than a predefined threshold, and wherein said end corresponds to a location on the floor area for which the analyzing unit determines an onset of a decrease of the sampled relative humidity or a negative slope of the sampled temperature, which slope is smaller than a predefined threshold.

The respective threshold is used to differentiate from noise and slower effects of changing relative humidity (RH), e.g. being near to open window/entering the bath room. An upper limit is less important because it depends mainly on a response time of the sensor and a velocity of the vacuum cleaner.

Further, according to an embodiment, the device comprises a housing having a bottom wall configured to face said floor area upon operation of the vacuum cleaner device on said floor area and a lateral wall (e.g. a circumferential lateral wall) that particularly extends from the bottom wall. Particularly, the lateral wall may form a front side of the housing, wherein particularly the device is configured to move or to be moved with the front side ahead in a movement direction. Further, particularly, the bottom wall comprises said opening of the suction duct, so that air can be sucked into the suction duct via said opening.

Furthermore, in an embodiment, particularly in case the vacuum cleaner device is configured to be moved manually on the floor area, the housing forms a head of the vacuum cleaner device that is manually movable on said floor area and comprises said opening of the suction duct so that air can be sucked into the suction duct/device via said head.

Further, according to an embodiment, the temperature sensor is mounted to the bottom wall or to the lateral wall of the housing or head of the vacuum cleaner device.

Particularly, the temperature sensor can be mounted to the front side of the housing or head of the vacuum cleaner device. In an embodiment, the temperature sensor comprises a distance to the floor area when the device rests on the floor area that is in the range from 1 mm to 100 mm.

Further, according to an embodiment, the at least one relative humidity sensor is mounted to the bottom wall or to the lateral wall. Particularly, the at least one relative humidity sensor is mounted to the front side. Particularly, in an embodiment, the at least one relative humidity sensor comprises a distance to the floor area when the device rests on the floor area that is in the range from 1 mm to 100 mm. The at least one relative humidity sensor can also be arranged in a suction duct or a hose of the vacuum cleaner device (e.g. in case of a car vacuum cleaner or an industrial vacuum cleaner).

Further, according to an embodiment, the suction duct comprises a constriction (e.g. a portion having a reduced inner diameter), wherein the temperature sensor is arranged in the constriction.

Further, according to an embodiment, the at least one relative humidity sensor is arranged in the suction duct. Due to such an arrangement of the relative humidity sensor, the latter is less exposed to mechanical damage.

Further, according to an embodiment, the at least one relative humidity sensor is arranged in the suction duct downstream a filter for filtering particles that is arranged in the suction duct. Particularly, the filter is arranged downstream the temperature sensor. Although a signal may be weaker, arranging the respective sensor in the suction duct increases protection of the respective sensor regarding contamination and mechanical damage.

Although the present invention is related to a vacuum cleaner device, it is also conceivable to apply the present invention to other devices, such as a mower, particularly a mower having a suction device (e.g. an agricultural machine). The mower can also be a lawn mower, particularly a robotic lawn mower, or to other household appliances. Particularly, in case of a mower (e.g. lawn mower), said floor area is a grass area and said wet spot corresponds to a spot of wet grass.

According to a further aspect of the present invention, a robotic device is proposed that has the single function of detecting a wet spot on the floor area. In such an embodiment, the device does not comprise an additional function such as vacuum cleaning or mowing but is exclusively dedicated to monitoring or detecting wet spots on said floor area using the temperature sensor and particularly relative humidity sensor as described herein.

Further, according to an embodiment, when the vacuum cleaner device detects a wet spot, the vacuum cleaner device is configured to at least one of: stop, move around the wet spot, clean up the wet spot (e.g. by sucking up a liquid forming the wet spot, e.g. through the suction duct, or by drying or removing the wet spot in another fashion), store a location of the wet spot in a data storage of the robotic device, output a warning signal (e.g. acoustic and/or optical warning signal).

Due to the fact that the respective location of a detected wet spot is stored, a user can look up the location (e.g., using a smart phone app) to allow the user to find the spot even after it has dried/been removed.

Further, according to an embodiment, the analyzing unit is configured to determine a size (e.g. a diameter) of a detected wet spot (or a size/diameter of a region of the floor area covered by the wet spot). Further, particularly the analyzing unit is configured to alert a user in case said size exceeds a pre-defined threshold. Thus, e.g. larger wet spots (e.g. due to an appliance leak) can be distinguished from smaller wet spots (e.g. due to pet urine etc.).

Particularly, in an embodiment, the analyzing unit is configured to use the velocity of the device with respect to the floor area to determine said size (e.g. diameter) of the wet spot on the floor area.

For this, the analyzing unit can be configured to determine said size (e.g. diameter) of the wet spot using a velocity of the vacuum cleaner device in a movement direction of the vacuum cleaner device as well as a determined location of a beginning of the wet spot and a determined location of an end of the wet spot along the movement direction of the vacuum cleaner device. Using two different temperature sensors, also the distance between the two temperature sensors can be used for determining the size of the wet spot.

Further, according to an embodiment, the vacuum cleaner device comprises at least one further temperature sensor configured to sample an air temperature in the vicinity of the device, wherein the at least one further temperature sensor is arranged in a further suction duct of the vacuum cleaner device.

Alternatively, the temperature sensor is arranged in a first branch of the suction duct and the at least one further temperature sensor is arranged in a second branch of the suction duct.

Further, according to an embodiment, the analysing unit is configured to detect a wet spot on said floor area using said sampled air temperature sampled by the temperature sensor and said sampled air temperature sampled by the at least one further temperature sensor.

According to a further embodiment, the analyzing unit is configured to determine a location and/or dimension of the wet spot using the temperatures sampled by the temperature sensor and the at least one further temperature sensor.

According to a further aspect of the present invention a computer-implemented method for detecting a wet spot is disclosed, the method comprising the steps of:

receiving a time series of an air temperature of air located above a floor area, detecting the presence of a wet spot on the floor area in case the air temperature shows a pre-defined temperature drop over a pre-defined period of time or in case a slope of the air temperature is negative and decreases below a predefined threshold.

According to an embodiment of the method, the temperature drop per period of time is larger than 0.2° C./s. Particularly, according to an embodiment, the temperature drop per period of time is in the range from 0.4° C./s to 1° C./s.

According to an embodiment of the method, the method further comprises the step of receiving a time series of a relative humidity of air located above the floor area.

Further, according to an embodiment, the step of detecting the presence of a wet spot corresponds to: detecting the presence of a wet spot on the floor area in case the air temperature shows a pre-defined temperature drop over a pre-defined period of time or in case the slope of the air temperature is negative and decreases below a predefined threshold, and in case the relative humidity shows a pre-defined increase over a predefined period of time or a slope of the relative humidity increases above a predefined threshold.

Further, according to an embodiment of the method, the relative humidity (RH) increase per time unit is larger than 0.1% RH/s. Preferably, according to an embodiment, it is in the range from 0.2% RH/s to 0.5% RH/s.

Furthermore, according to an embodiment of the method, particularly for reducing false positives, the method further comprises at least one of following steps: determining if the temperature drop is followed by an increase of the temperature after passing of a pre-defined time span to confirm detection of the wet spot; determining if the relative humidity increases when the temperature drop occurs and/or decreases when said increase of the temperature (after passing of said pre-defined time span) occurs to confirm detection of the wet spot; determining if a total temperature drop associated with the detected wet spot exceeds a predefined threshold to confirm detection of the wet spot; determining if a total relative humidity increase associated with the detected wet spot exceeds a pre-defined threshold to confirm detection of the wet spot.

Furthermore, according to an embodiment, the method may further comprise the step of receiving a velocity of a vacuum cleaner device and determining a size of a detected wet spot in a movement direction of a vacuum cleaner device using the velocity, as well as a location of a beginning of the detected wet spot and a location of an end of the detected wet spot with respect to the movement direction.

Particularly, said location of the beginning of the detected wet spot is determined as a location at which the temperature shows an onset of a drop in the temperature or a negative slope of the temperature, which slope is smaller than a predefined threshold; or as a location at which the relative humidity shows an onset of an increase of the relative humidity or a positive slope of the relative humidity, which slope is larger than a predefined threshold.

Furthermore, particularly, said location of an end of the detected wet spot is determined as a location at which the temperature shows an onset of an increase of the sampled temperature or a positive slope of the sampled temperature, which positive slope is larger than a predefined threshold; or as a location at which the relative humidity shows an onset of a decrease in the relative humidity or a negative slope of the relative humidity, which slope is smaller than a predefined threshold.

According to a further aspect, a non-transitory computer readable medium is disclosed having stored thereon instructions that will cause a processor (e.g. a processor comprised by the analyzing unit of the vacuum cleaner device) to conduct the above-described method according to the present invention.

BRIEF DESCRIPTION OF THE DRAWINGS

Attention is now directed to the attached drawings, wherein like reference numerals or characters indicate corresponding or like components. In the drawings

DETAILED DESCRIPTION

Figure 1:
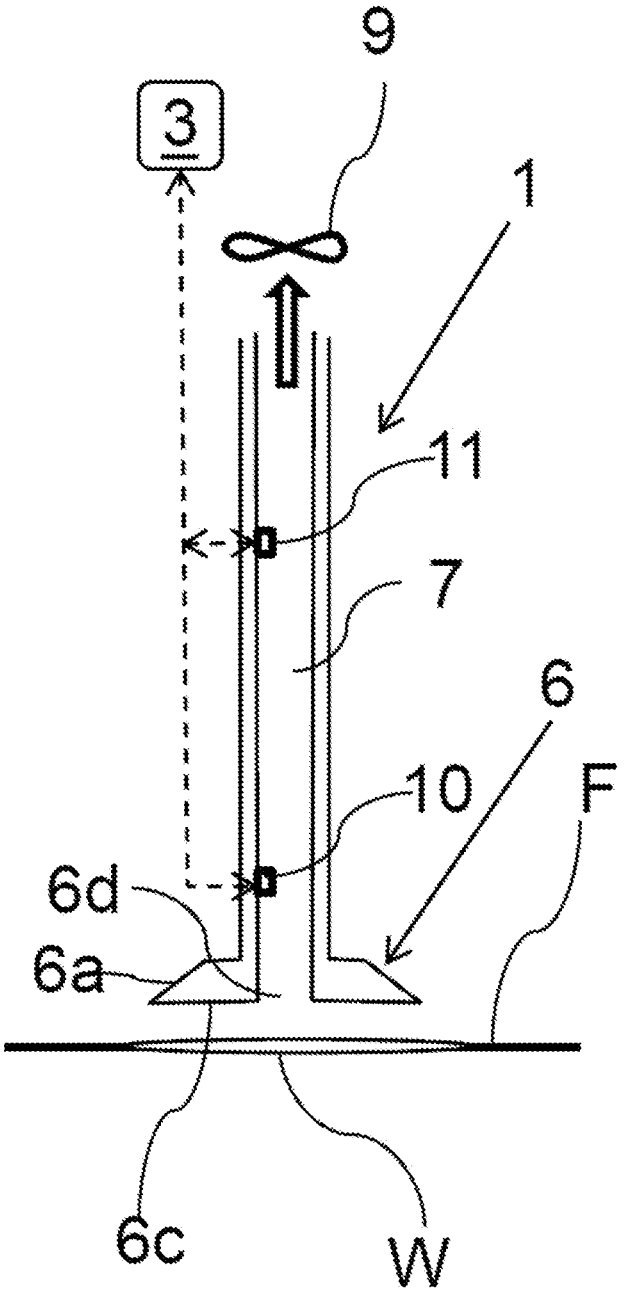
FIG. 1 shows a schematical cross-sectional view of an embodiment of a vacuum cleaner device according to the present invention comprising a temperature sensor arranged in a suction duct of the device.

FIG. 1 shows a vacuum cleaner device 1 for operation on a floor area F, wherein the device 1 comprises a suction duct 7 and an actuator 9 (e.g. a ventilator) that is configured to generate an underpressure in the suction duct 7 so that air is sucked into the suction duct 7. Further, the device 1 comprises a temperature sensor 10 configured to sample an air temperature in the vicinity of the device 1, wherein said temperature sensor 10 is arranged in the suction duct 7. Furthermore, the vacuum cleaner device 1 comprises an analyzing unit 3 configured to detect a wet spot W on said floor area F using said sampled air temperature.

Particularly, the device 1 comprise a head 6 having a bottom wall **6*c* configured to face said floor area F upon operation of the device 1 on said floor area F. Further, the head 6 may comprise a circumferential lateral wall 6*a* extending from the bottom wall 6*c*. Alternatively, instead of arranging the temperature sensor 10 in the suction duct 7, the temperature sensor 10 can also be arranged on the lateral wall 6*a* or on the bottom wall 6*c*, particularly in proximity to the opening 6*c* of the suction duct 7 so that the temperature sensor 10 is arranged in a region that experiences a suction effect generated by the suction duct 7 and actuator 9**.

Particularly, for detecting a wet spot W, particularly when the head 6 of the vacuum cleaner 1 is moving on the floor area F, the analyzing unit 3 analyzes the current air temperatures sampled with the temperature sensor 10 and concludes detection of a wet spot W in case the sampled air temperature drops by a predefined amount within a predefined period of time.

Furthermore, in addition, at least one relative humidity sensor 11 can be arranged in the suction duct 7 (or on the head 6), wherein the at least one relative humidity sensor 11 can be used to confirm detection of the wet spot W, since the sampled relative humidities show an increase when the head 6 approaches a wet spot W (see also experimental data described below). Furthermore, as described above, a beginning B and an end E of the wet spot W with respect to the movement direction D can be detected (e.g. for determining a size/diameter of the wet spot W).

Figure 2:
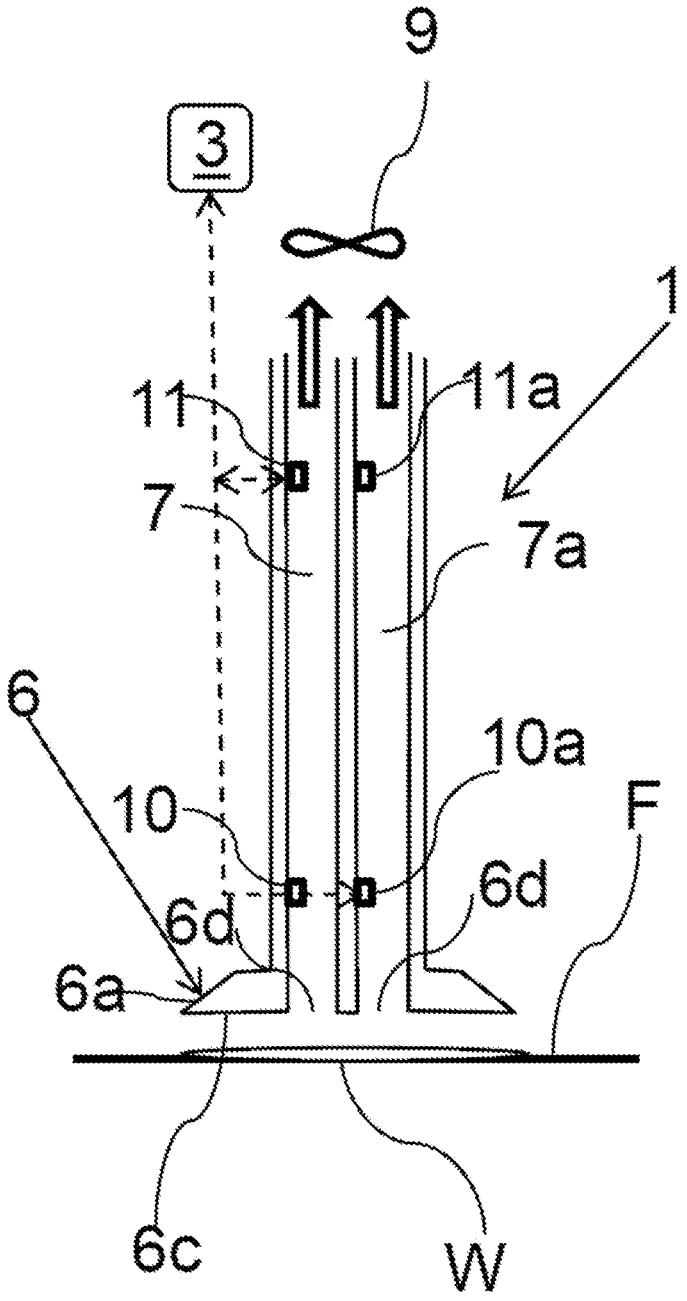
FIG. 2 shows a schematical cross sectional view of a further embodiment of a vacuum cleaner device according to the present invention comprising two separate suctions ducts, wherein a temperature sensor is arranged in each suction duct.

FIG. 2 shows a modification of the embodiment shown in FIG. 1, wherein here the vacuum cleaner device 1 comprises two suction ducts 7, 7*a*, starting from an associated opening 6*d* formed in the bottom wall 6*c* of the head 6, wherein a temperature sensor 10, 10*a* is arranged in each suction duct 7, 7*a*. Furthermore, a relative humidity sensor 11, 11*a* can be arranged in each suction duct 7, 7*a*, too, in order to improve detection of wet spots W. In the embodiment shown in FIG. 2, two temperature signals (and optionally relative humidity signals) can be used to determine the presence of a wet spot W as described above in conjunction with FIG. 1.

Figure 3:
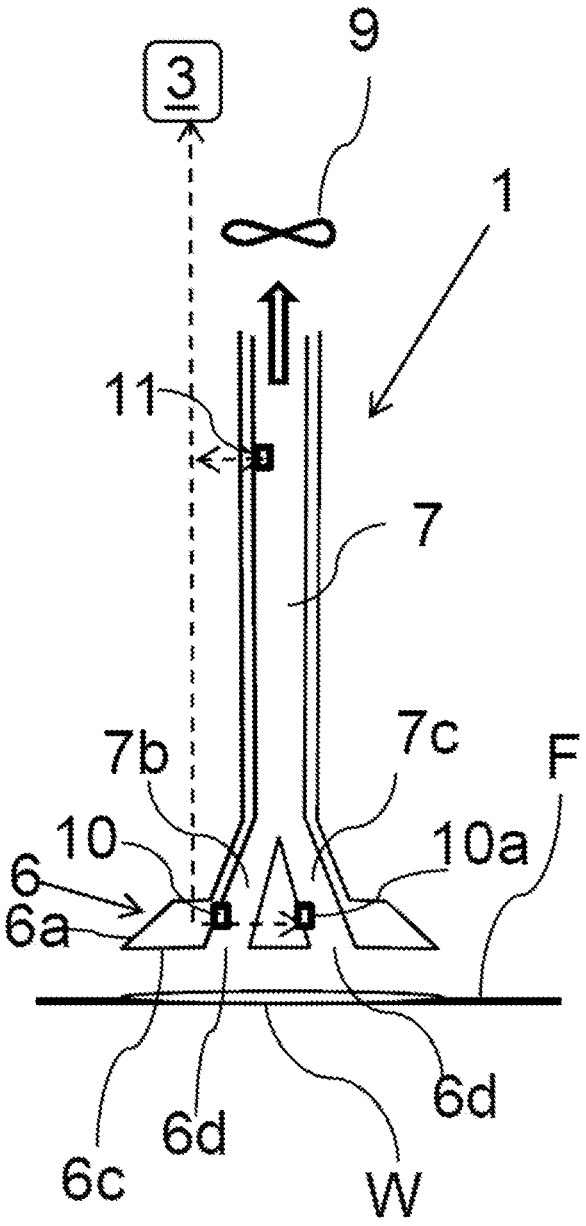
FIG. 3 shows a schematical cross sectional view of a further embodiment of a vacuum cleaner device according to the present invention comprising a suction duct having two branches, wherein a temperature sensor is arranged in each branch of the suction duct.

Furthermore, FIG. 3 shows a further modification of the embodiment shown in FIG. 1, wherein here the suction duct 7 branches off and comprises two branches 7*b*, 7*c*, wherein each branch 7*b*, 7*c* ends at its respective opening 6*d* formed in the bottom wall 6*c* of the head 6. Also here, two temperature signals (and optionally relative humidity signals) can be used to determine the presence of a wet spot W as described above in conjunction with FIG. 1.

Figure 4:
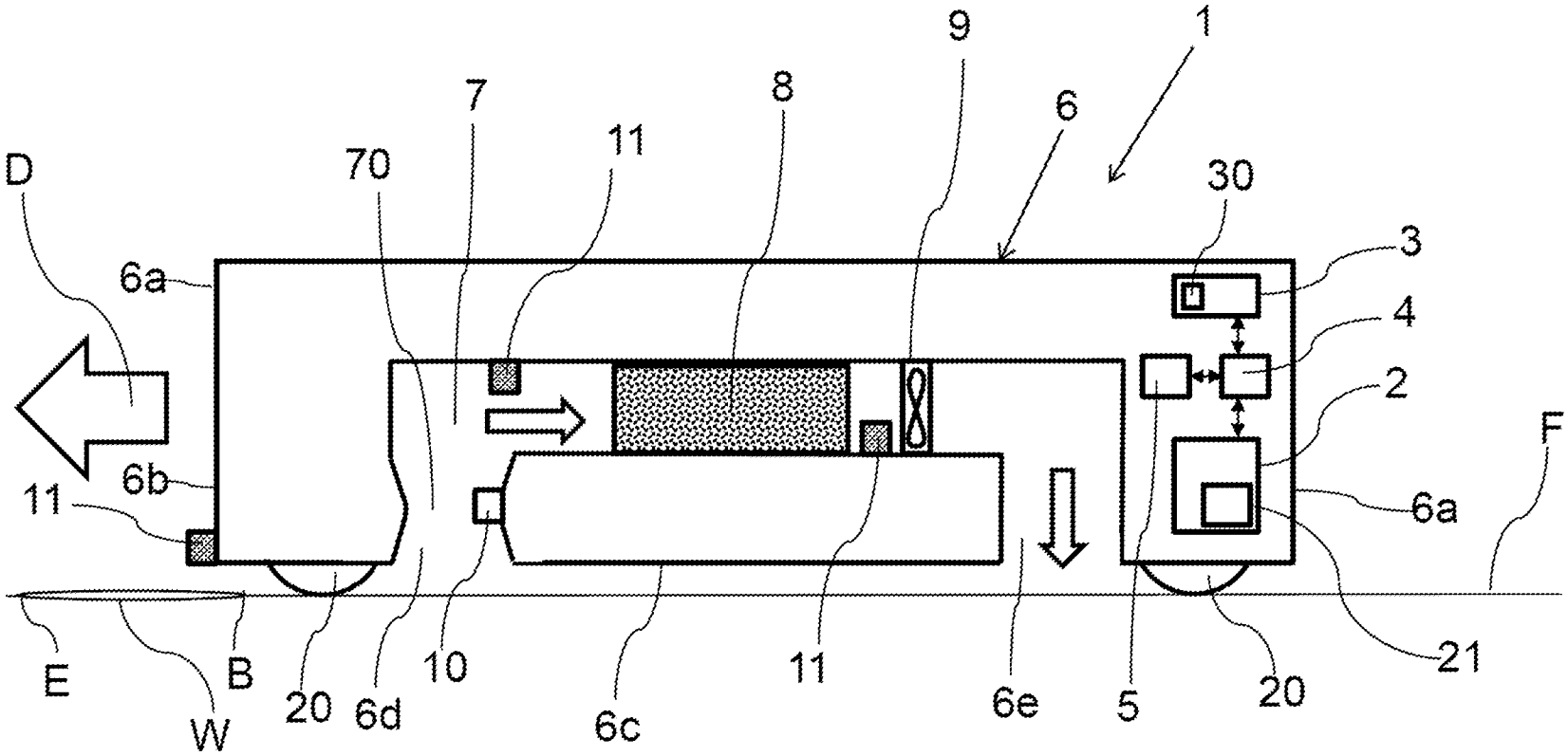
FIG. 4 shows a schematical cross-sectional view of an embodiment of a robotic vacuum cleaner device according to the present invention.

Furthermore, FIG. 4 shows a further embodiment of a vacuum cleaner device 1 according to the present invention in form of a robotic vacuum cleaner device 1. As shown in FIG. 4 such a robotic device 1 can comprise a drive system 2 configured to move the device 1 autonomously on the floor area F, a temperature sensor 10 for sampling an air temperature in the vicinity of the device 1 (e.g. upon movement of the device 1 on the floor area F), and an analyzing unit 3 configured for detecting a wet spot W on said floor area F using said air temperature as an input, particularly when the device 1 approaches said wet spot W.

For moving, the drive system 2 of the robotic device 1 can comprise rotatable wheels 20 via which the robotic device 20 is supported on the floor area F. For example, a first wheel 20 can be driven with a first motor 21 and—similarly—a second wheel can be independently driven with a second motor (not shown) of the drive system 2 which also allows steering of the device 1 in a simple manner. Other ways of steering and driving the device 1 can also be used.

Further, the robotic device 1 can comprise an electronic control unit 4 to control the drive system 2, particularly the respective motor 20, so that the device 1 can move autonomously on said floor area F. The device 1 may further comprise a navigation system 5 for determining the current location (e.g. coordinates) of the robotic device 1 on the floor area F.

The device 1 can further comprise a housing 6 having a bottom wall 6*c* configured to face said floor area F upon operation of the robotic device 1 on said floor area F.

Further, the device 1 comprises a circumferential lateral wall 6*a* that also forms a front side 6*b* of the device when the device 1 moves in a movement direction D with the front side 6*b* ahead.

In an embodiment, the temperature sensor 10 can be mounted to the bottom wall 6*c* or to the lateral wall 6*a*, particularly to the front side 6*b* (wherein the temperature sensor 10 is preferably arranged in proximity to the opening 6*d*, see below, so that the temperature sensor 10 is arranged in a region where a suction effect/air flow generated by the device 1 is present). Particularly, in order to provide better protection of the temperature sensor 10, the latter is arranged in a suction duct 7 of the device 1 which is shown in FIG. 4.

Particularly, the suction duct 7 can extend from an opening 6*d* formed in the bottom wall 6*c* of the housing 6 and may extend from said opening 6*d* forming an intake to an outtake opening 6*e*. The duct 7 may comprise a constriction 70, wherein particularly the temperature sensor 10 is arranged in the constriction 70. Further, a filter 8 can be arranged in the suction duct 7 for filtering particles sucked into the suction duct 7 due to an underpressure generated by an actuator 9 (e.g. a ventilator) that can be arranged downstream the filter 8.

Furthermore, besides the temperature sensor 10, the device 1 can comprise at least one or several (e.g. one to three) relative humidity sensors 11.

Particularly, the at least one relative humidity sensor 11 can also be mounted to the bottom wall 6*c* or to the lateral wall 6*a*, particularly to the front side 6*b*, as shown in FIG. 4.

In order to offer better protection, the at least one relative humidity sensor 11 can also be arranged in the suction duct 7, as also shown in FIG. 4, particularly, the at least one relative humidity sensor 11 can be arranged downstream the filter 8 and particularly upstream said actuator 9. In case the at least one relative humidity sensor 10 is arranged in the suction duct 7 it is less exposed to mechanical damage.

Particularly, for detecting a wet spot W, e.g. in front of the device 1, when the device is moving in the movement direction D, the analyzing unit 3 analyzes the current air temperatures sampled with the temperature sensor 10 and concludes detection of a wet e.g. spot in case the sampled air temperature drops by a predefined amount within a predefined period of time. Alternatively, also the slope of the sampled temperature and particularly other quantities related to temperature and/or relative humidity discussed above can be used to detect a wet spot W.

Particularly, the at least one relative humidity sensor 11 can be used to confirm detection of the wet spot W, since the sampled relative humidities show an increase when they approach the respective wet spot W (see also above).

Particularly, when the vacuum cleaner device 1 detects a wet spot W, the device 1 is configured to at least one of: stop, move around the wet spot W, remove the wet spot W, store a location of the wet spot W in a data storage 30 of the robotic device 1, output a warning signal (e.g. acoustic and/or optical warning signal).

Particularly, the device 1 allows a user to look up the location of the wet spot via an interface of the device (e.g. via a smart phone app) so that the user can find the wet spot even in case it has been removed by the device 1 for inspection.

Furthermore, the FIGS. 5 to 12 show experimental data recorded with temperature and relative humidity sensors that are located in the suction duct 7 of a vacuum cleaner device or on the head 6 (e.g. lateral side 6*a*).

Figure 5:
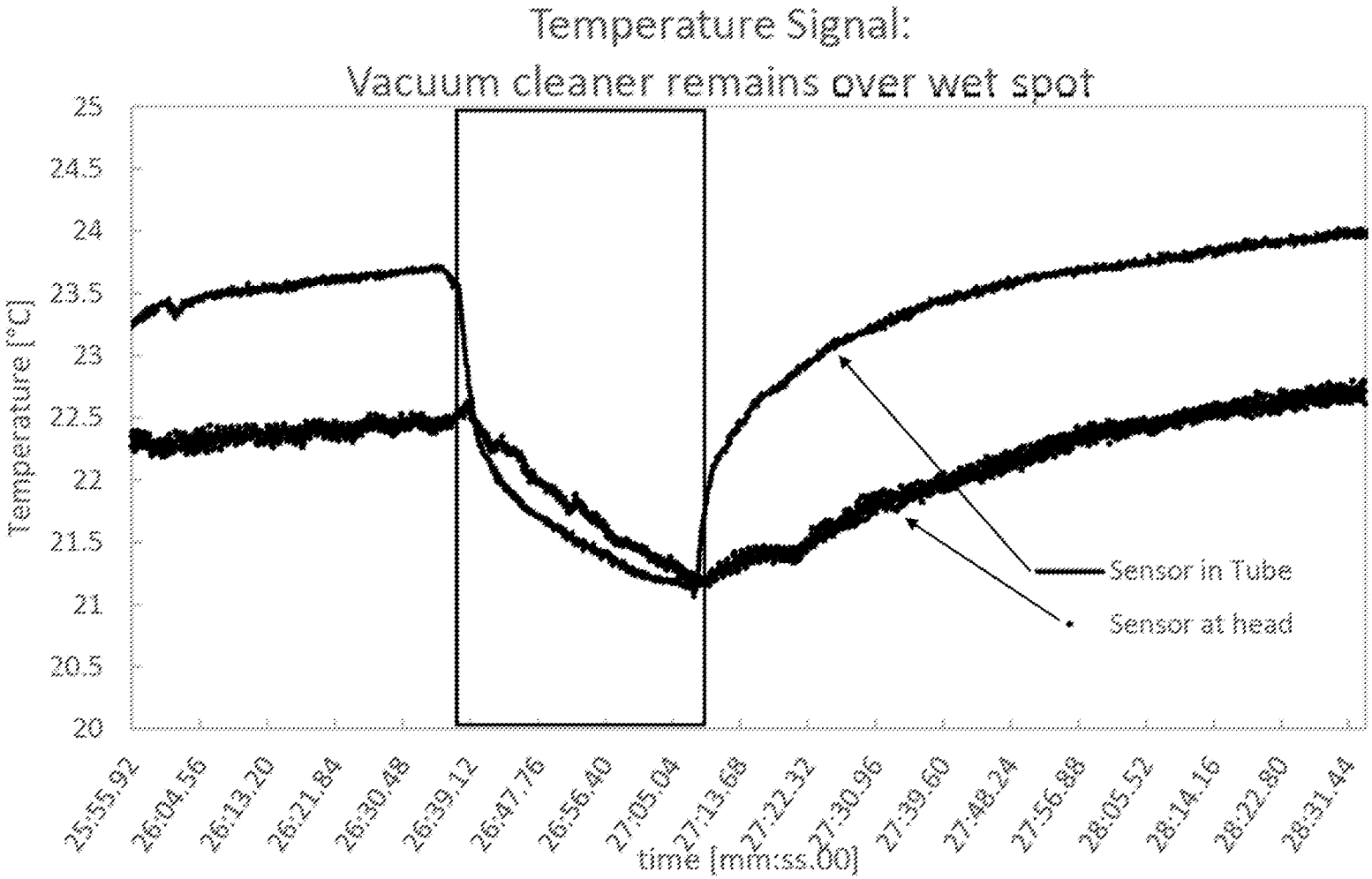
FIG. 5 shows experimental data, particularly a temperature signal of a temperature sensor that is arranged in the suction duct (denoted as tube) as well as a temperature signal of a temperature sensor that is arranged outside the suction duct on the head of the vacuum cleaner device, wherein the head has been moved over a wet spot.

Particularly, FIG. 5 shows a temperature signal of a temperature sensor that is arranged in the suction duct 7 (denoted as tube) as well as a temperature signal of a temperature sensor 10 that is arranged outside the suction duct 7 on the head 6 of the vacuum cleaner device 1, wherein the head 6 has been moved over a wet spot W. FIG. 5 clearly shows the increase in the sampled temperature for both sensor locations.

Figure 6:
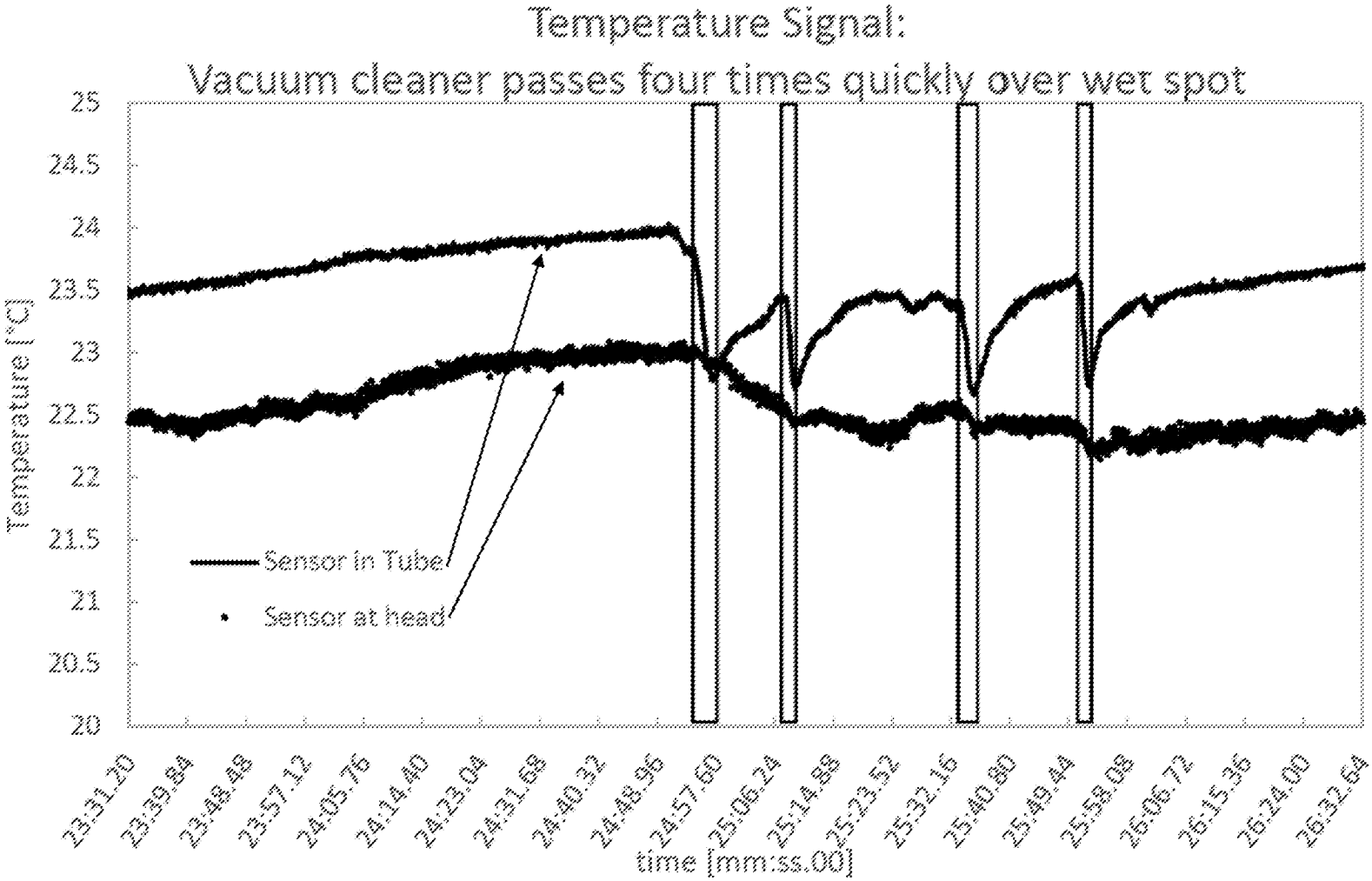
FIG. 6 shows a temperature signal of a temperature sensor that is arranged in the suction duct as well as a temperature signal of a temperature sensor that is arranged outside the suction duct on the head of the vacuum cleaner device, wherein the signals are shown for four passes of the head of the vacuum cleaner device over the wet spot.

Furthermore, FIG. 6 shows a temperature signal of a temperature sensor that is arranged in the suction duct 7 as well as a temperature signal of a temperature sensor that is arranged outside the suction duct 7 on the head 6 of the vacuum cleaner device 1, wherein the signals are shown for four passes of the head 6 of the vacuum cleaner device 1 over the wet spot W. Particularly, FIG. 6 demonstrates that a wet spot can also be detected when the device 1 is moving, since the respective signal shows a characteristic drop in case of a wet spot (here approx. at times 24:57, 25:06, 25:32, 25:49).

Figure 7:
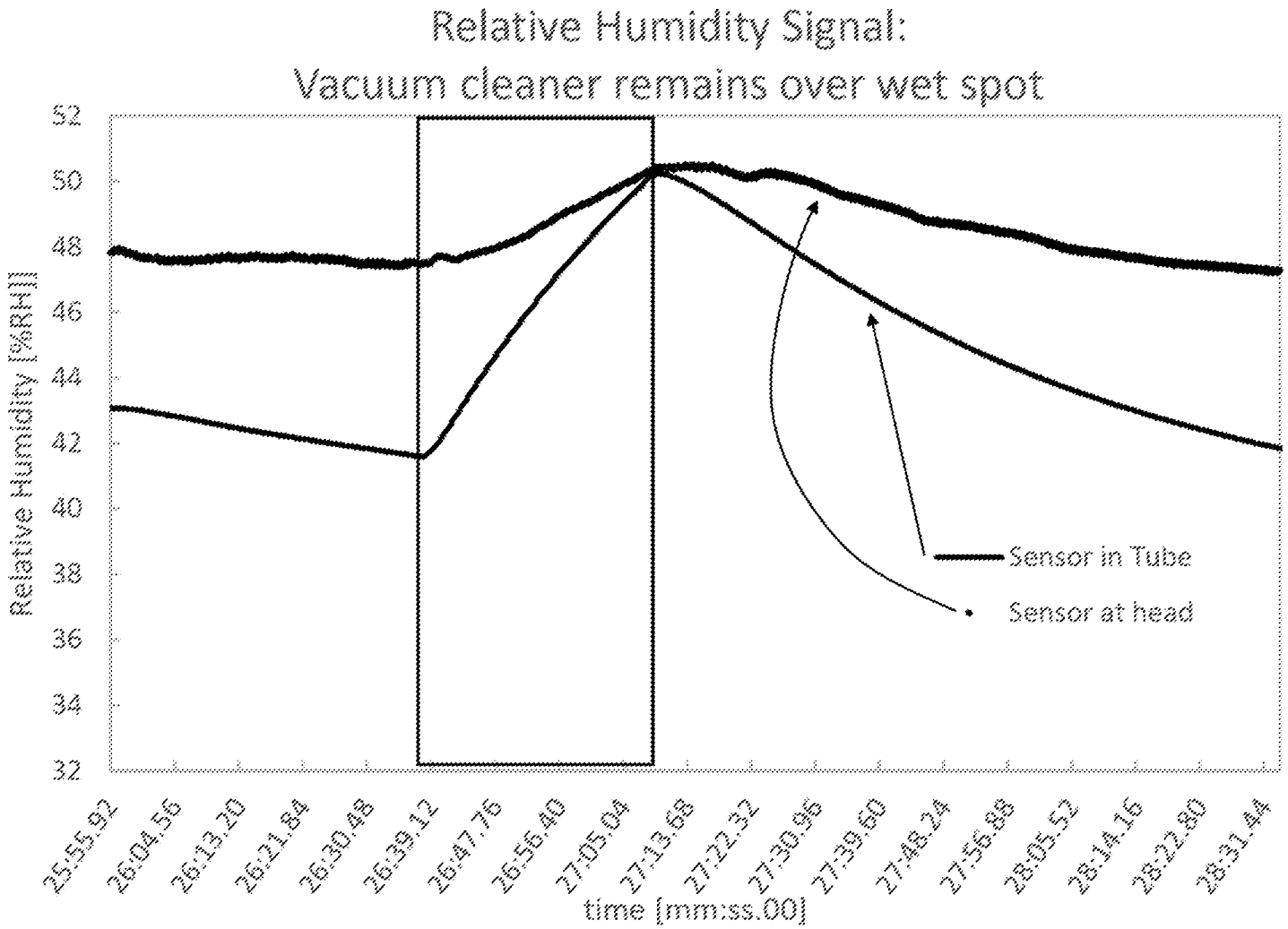
FIG. 7 shows a relative humidity signal of a relative humidity sensor that is arranged in the suction duct (denoted as tube) as well as a relative humidity signal of a relative humidity sensor that is arranged outside the suction duct on the head of the vacuum cleaner device, wherein the head has been moved over a wet spot.

Further, FIG. 7 shows a relative humidity signal of a relative humidity sensor 11 that is arranged in the suction duct 7 (denoted as tube) as well as a relative humidity signal of a relative humidity sensor 11 that is arranged outside the suction duct 7 on the head 6 of the vacuum cleaner device 1, wherein the head 6 has been moved over a wet spot. As can be seen from FIG. 7, the sampled relative humidity clearly increases for both sensor locations due to the wet spot.

Figure 8:
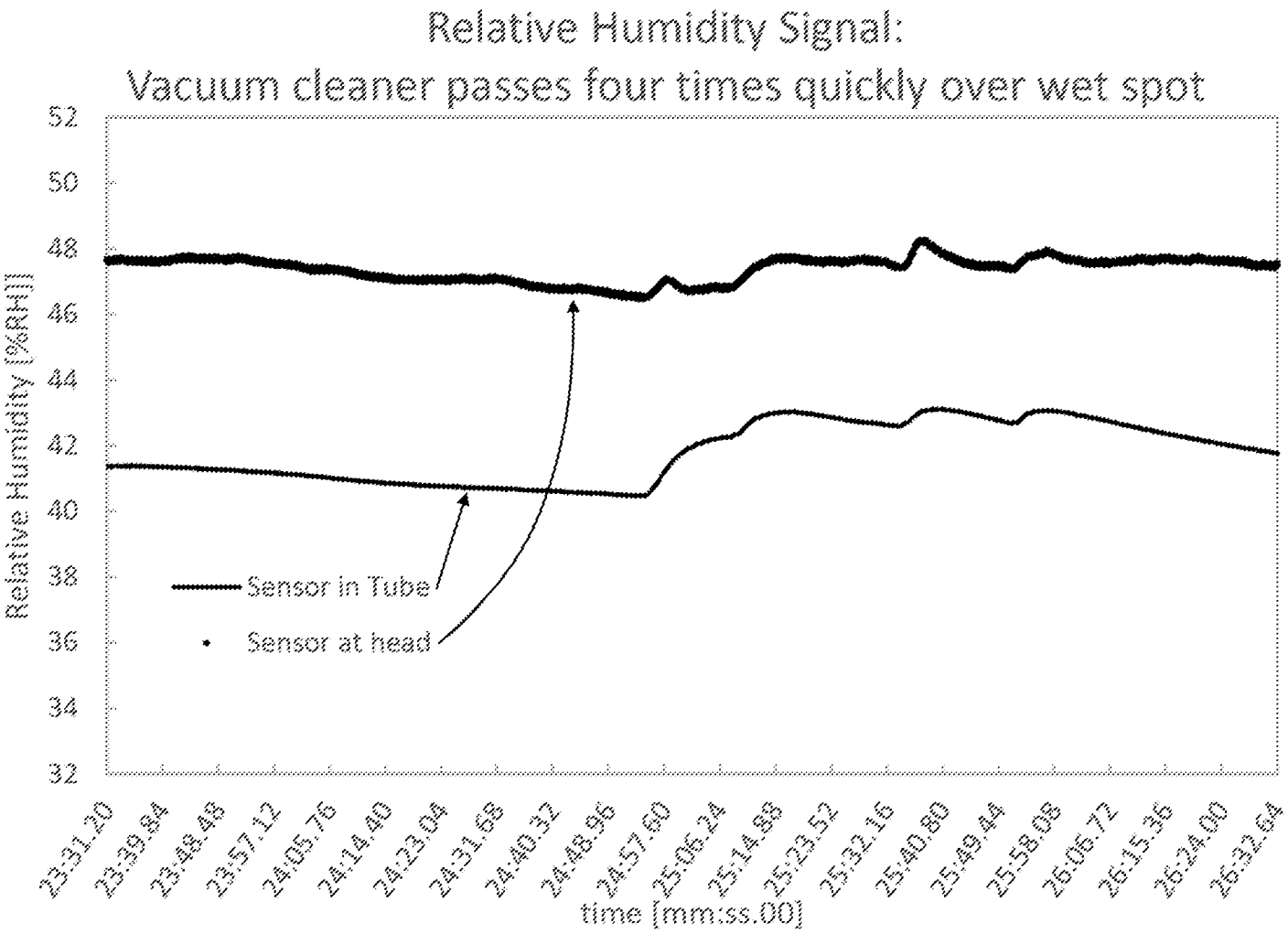
FIG. 8 shows a relative humidity signal of a relative humidity sensor that is arranged in the suction duct (denoted as tube) as well as a relative humidity signal of a relative humidity sensor that is arranged outside the suction duct on the head of the vacuum cleaner device, wherein the signals are shown for four passes of the head of the vacuum cleaner device over the wet spot.

In addition, FIG. 8 shows the signals of FIG. 7 in case the head 6 passes over the wet spot (here four such passes).

Figure 9:
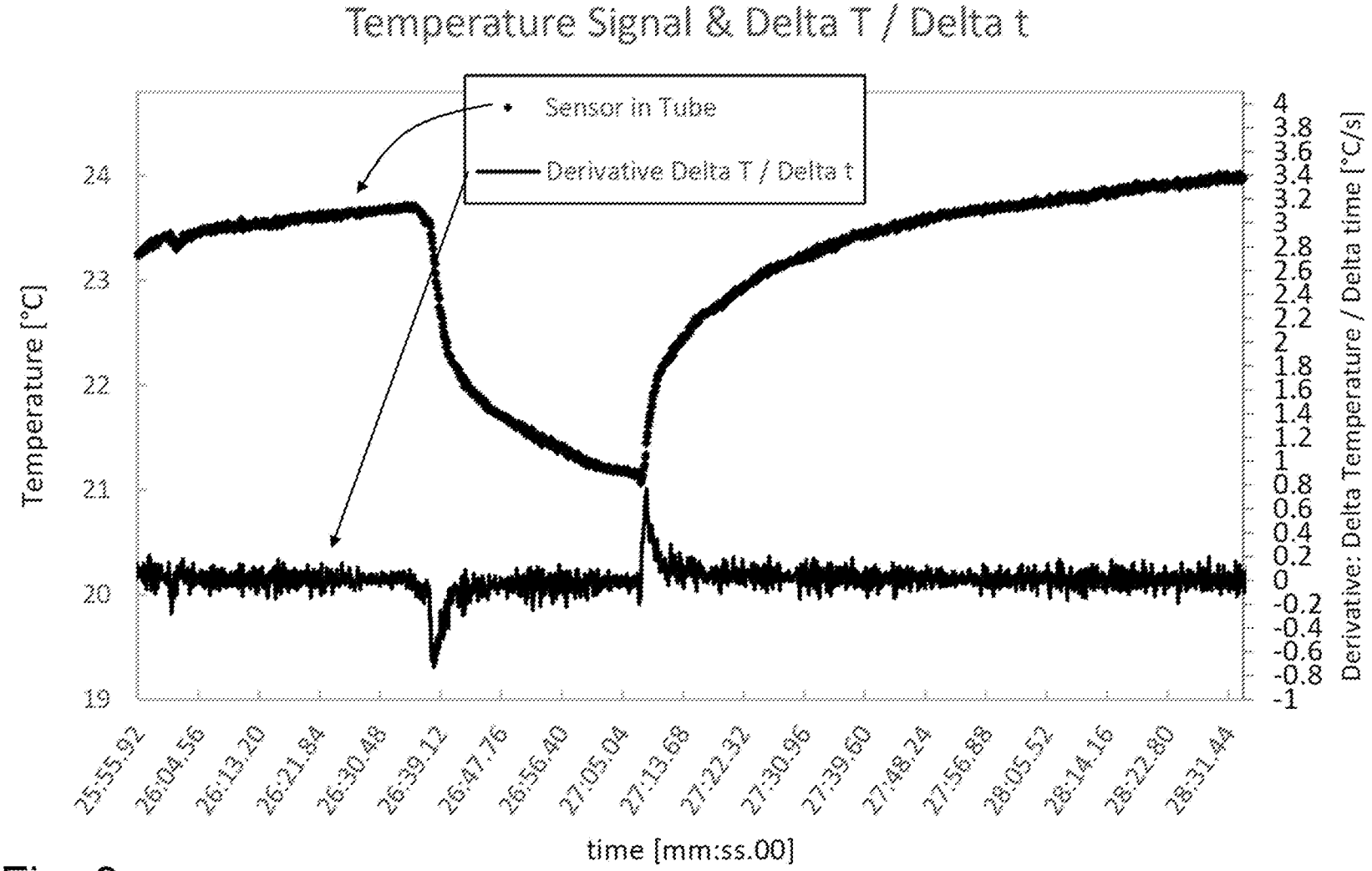
FIG. 9 shows the temperature signal of a temperature sensor arranged in the suction duct (denoted as tube) and the slope of the temperature signal when the head of vacuum cleaner devices passes over the wet spot.
Figure 10:
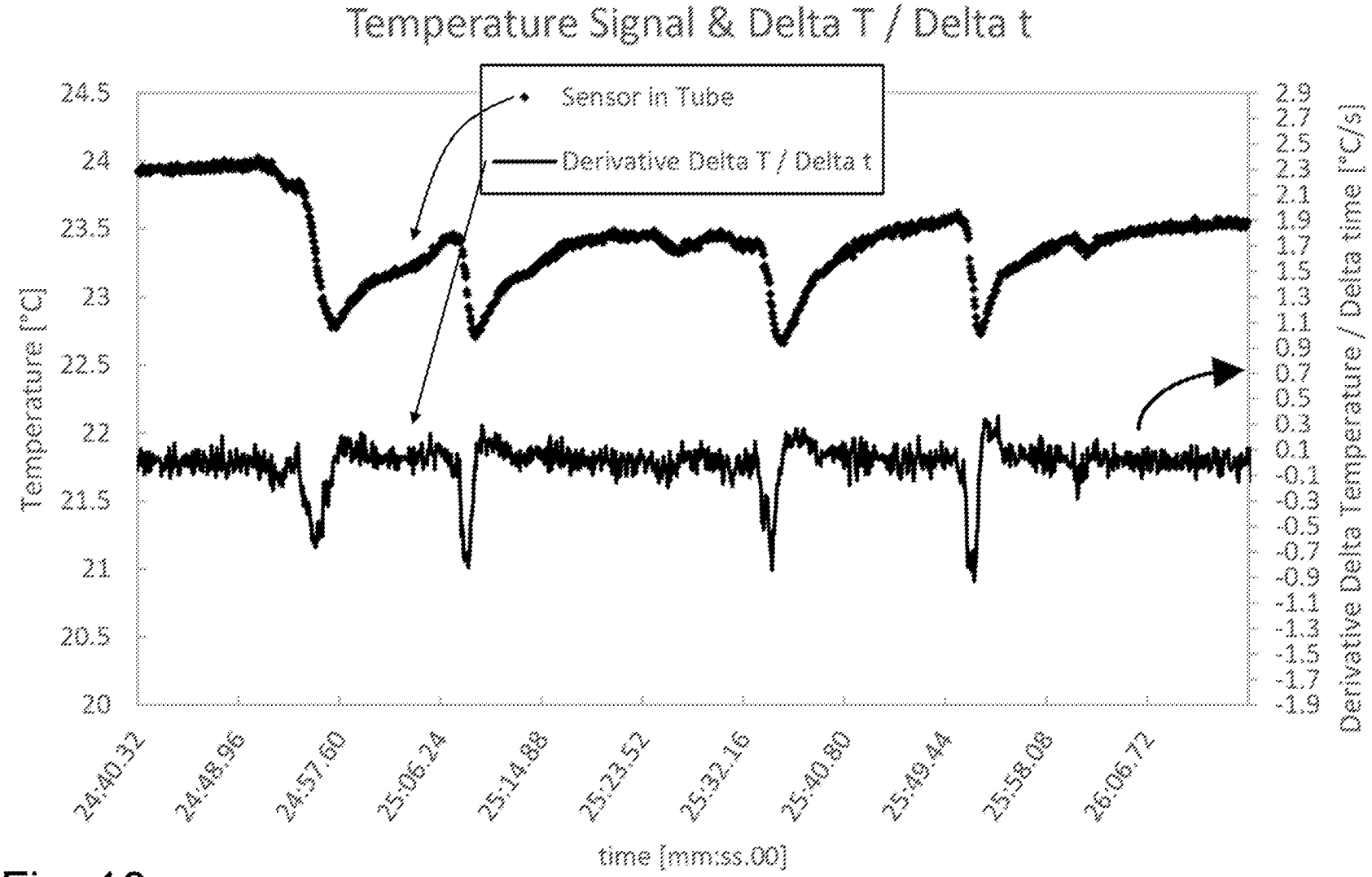
FIG. 10 shows a temperature signal of a temperature sensor that is arranged in the suction duct (denoted as tube) as well as the slope of the temperature signal, wherein the signal/slope is shown for four passes of the head of the vacuum cleaner device over the wet spot.

FIGS. 9 to 12 show further experimental data to show that also the slope of the temperature signal (i.e. the sampled temperature) of a temperature sensor 10 or the slope of the relative humidity signal (i.e. the sampled relative humidity) of a relative humidity sensor 11 is a suitable detection signal for wet spots. Here, the respective sensor 10, 11 is arranged in the suction duct 7 of a vacuum cleaner device 1 and the head 6 of the vacuum cleaner device 1 via which air is sucked into the suction duct 7 passes over the wet spot. FIG. 9 shows the temperature signal and its derivative with respect to time (i.e. the slope of the sampled temperature) for a single pass of the head 6 of the vacuum cleaner device 1 over the wet spot, while FIG. 10 shows four succeeding passes over the wet spot.

Figure 11:
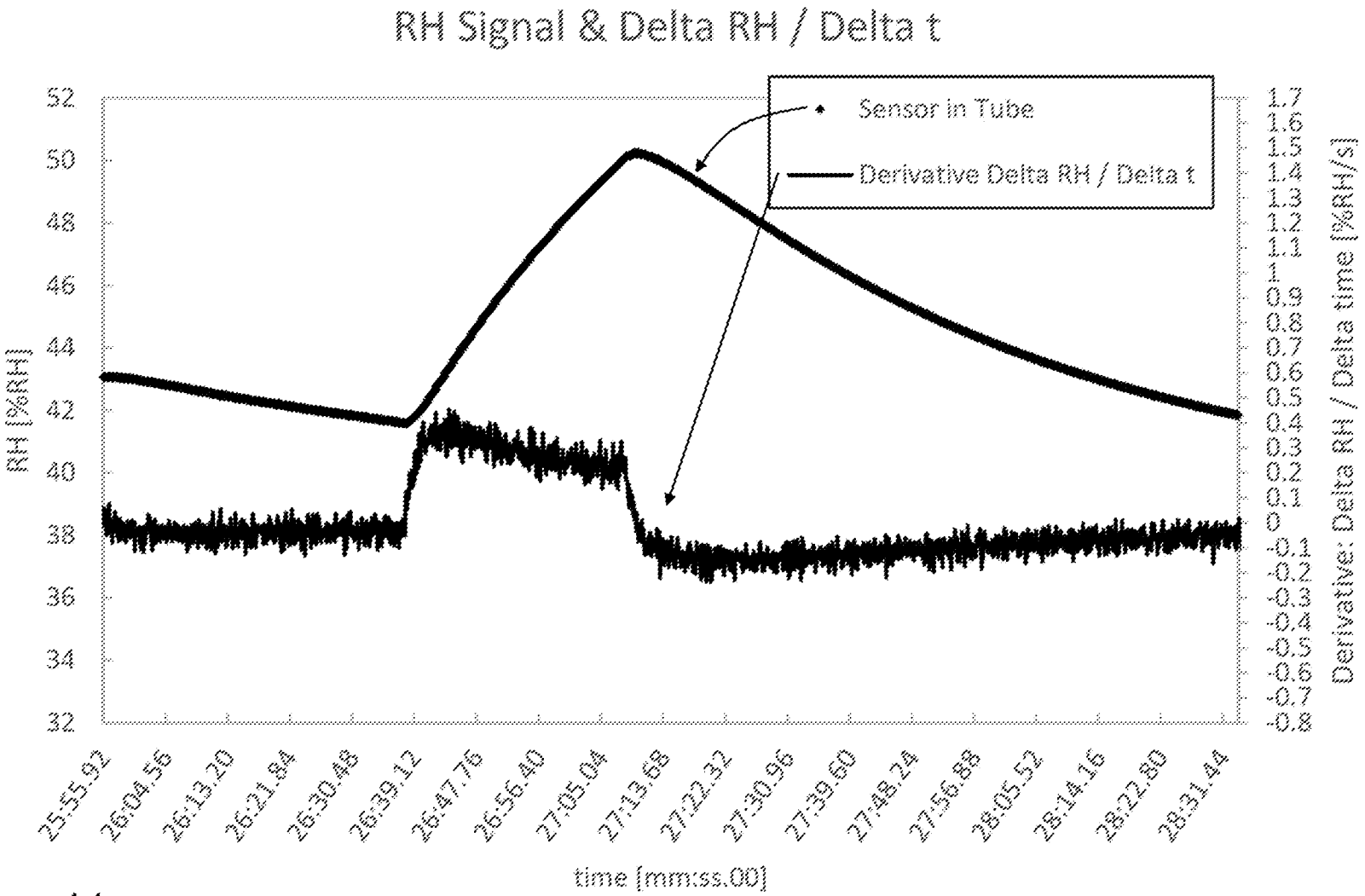
FIG. 11 shows the relative humidity signal of a relative humidity sensor arranged in the suction duct (denoted as tube) and the slope of the relative humidity signal when the head of vacuum cleaner devices passes over the wet spot.
Figure 12:
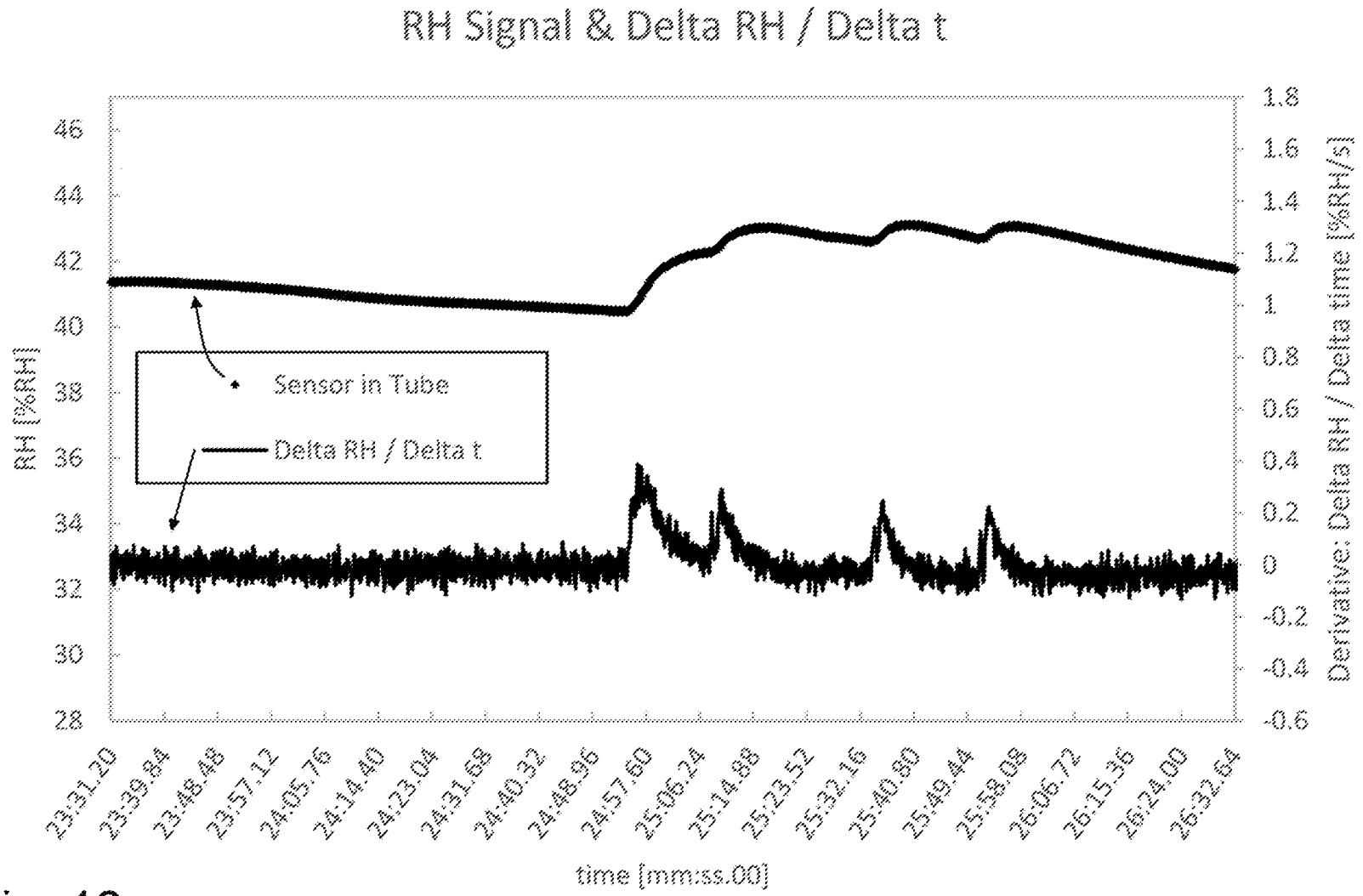
FIG. 12 shows a relative humidity signal of a relative humidity sensor that is arranged in the suction duct (denoted as tube) as well as the slope of the relative humidity signal, wherein the signal/slope is shown for four passes of the head of the vacuum cleaner device over the wet spot.

FIGS. 11 and 12 show the same situation for the relative humidity signal of a relative humidity sensor 11 that is arranged in the suction duct 7. Also FIGS. 11 and 12 demonstrate that the relative humidity signal (sampled relative humidity) as well as the derivative of the relative humidity signal (i.e. the slope of the sampled relative humidity) can be used to detect wet spots.

While a vacuum cleaner device has been shown and described above, this is exemplary only.

The above-disclosed subject matter can also be applied with and adapted for other (e.g. robotic or manually operable) devices that perform various tasks, including cleaning, sweeping, polishing, lawn mowing, gardening etc.

The vacuum cleaner devices disclosed herein have been described with exemplary reference to specific features and in a manner sufficient to enable persons of ordinary skill in the art to readily reduce any of the embodiments of the present invention to practice without undue experimentation and using conventional techniques. While preferred embodiments of the present invention have been described, so as to enable one of skill in the art to practice the present invention, the preceding description is intended to be exemplary only. Moreover, the embodiments and components thereof are exemplary.

This description should not be used to limit the scope of the invention, which should be determined by reference to the following claims.

We claim:

1. A vacuum cleaner device for operation on a floor area, comprising:

a suction duct and an actuator arranged and configured to generate an underpressure in the suction duct so that air is sucked into the suction duct, a temperature sensor configured to sample an air temperature in the vicinity of the device, wherein said temperature sensor is arranged in the suction duct or adjacent an opening of the suction duct, and an analyzing unit configured to detect a wet spot on said floor area using said sampled air temperature, wherein the analyzing unit is configured to detect the presence of a wet spot on the floor area in case the sampled air temperature shows a predefined temperature drop over a predefined period of time or in case a slope of the sampled air temperature is negative and decreases below a predefined threshold, and wherein the temperature drop per period of time is larger than 0.2° C./s, and/or wherein the temperature drop per period of time is in the range from 0.4° C./s to 1° C./s.

2. The vacuum cleaner device according to claim 1, wherein the analyzing unit is further configured to at least one of: determine if the temperature drop is followed by an increase of the sampled temperature after passing of a pre-defined time span to confirm detection of the wet spot; determine if a relative humidity sampled by the vacuum cleaner device increases when the temperature drop occurs and/or decreases when said increase of the sampled temperature occurs to confirm detection of the wet spot; determine if a total temperature drop associated with the detected wet spot exceeds a pre-defined threshold to confirm detection of the wet spot; determine if a total relative humidity increase associated with the detected wet spot exceeds a pre-defined threshold to confirm detection of the wet spot.

3. The vacuum cleaner device according to claim 1, wherein the vacuum cleaner device comprises at least one relative humidity sensor configured to sample a relative humidity of the air in the vicinity of the vacuum cleaner device.

4. The vacuum cleaner device according to claim 3, wherein the analyzing unit is configured to detect a wet spot on said floor area using said sampled air temperature and said sampled relative humidity.

5. The vacuum cleaner device according to claim 4, wherein the analyzing unit is configured to detect the presence of a wet spot on the floor area in case the sampled air temperature shows a predefined temperature drop over a predefined period of time or a slope of the sampled temperatures is negative and decreases below a predefined threshold, and in case the relative humidity shows a predefined increase over a predefined period of time or a slope of the sampled relative humidity increases above a predefined threshold.

6. The vacuum cleaner device according to claim 1, wherein the device comprises a housing having a bottom wall configured to face said floor area upon operation of the vacuum cleaner device on said floor area, wherein the bottom wall comprises said opening, and wherein the housing comprises a lateral wall.

7. The vacuum cleaner device according to claim 1, wherein the suction duct comprises a constriction, wherein the temperature sensor is arranged in the constriction.

8. The vacuum cleaner device according to claim 6, wherein the temperature sensor is mounted to the bottom wall or to the lateral wall adjacent said opening.

9. The vacuum cleaner device according to claim 3, wherein the at least one relative humidity sensor is mounted to a bottom wall of a housing of the vacuum cleaner device or to a lateral wall of a housing of the vacuum cleaner device.

10. The vacuum cleaner device according to claim 3, wherein the at least one relative humidity sensor is arranged in the suction duct.

11. The vacuum cleaner device according to claim 10, wherein the at least one relative humidity sensor is arranged in the suction duct downstream a filter for filtering particles that is arranged in the suction duct.

12. The vacuum cleaner device according to claim 1, wherein the vacuum cleaner device is a robotic vacuum cleaner device for autonomous operation on the floor area.

13. The vacuum cleaner device according to claim 12, wherein the vacuum cleaner device comprises a drive system that is configured to move the device.

14. The vacuum cleaner device according to claim 1, wherein when the vacuum cleaner device detects a wet spot, the vacuum cleaner device is configured to at least one of: stop, move around the wet spot, clean up the wet spot, store and/or transmit a location of the wet spot, output a warning signal.

15. The vacuum cleaner device according to claim 1, wherein the analyzing unit is configured to determine a size of a detected wet spot in a movement direction of the vacuum cleaner device using a velocity of the vacuum cleaner device in the movement direction, as well as a location of a beginning of the detected wet spot and a location of an end of the detected wet spot with respect to the movement direction.

16. The vacuum cleaner device according to claim 15, wherein the analyzing unit is configured to determine said location of a beginning of the detected wet spot as a location at which the analyzing unit determines one of: an onset of a drop of the sampled temperature; a negative slope of the sampled temperature, which slope is smaller than a predefined threshold; an onset of an increase of a sampled relative humidity; a positive slope of the sampled relative humidity, which slope is larger than a predefined threshold.

17. The vacuum cleaner device according to claim 15, wherein the analyzing unit is configured to determine said location of an end of the detected wet spot as a location at which the analyzing unit determines one of: an onset of an increase of the sampled temperature; a positive slope of the sampled temperature, which positive slope is larger than a predefined threshold; an onset of a decrease of the a sampled relative humidity; a negative slope of the sampled relative humidity, which slope is smaller than a predefined threshold.

18. The vacuum cleaner device according to claim 1, wherein the vacuum cleaner device comprises at least one further temperature sensor configured to sample an air temperature in the vicinity of the device, wherein the at least one further temperature sensor is arranged in a further suction duct of the vacuum cleaner device, or wherein the temperature sensor is arranged in a first branch of the suction duct and the at least one further temperature sensor is arranged in a second branch of the suction duct.

19. The vacuum cleaner device according to claim 18, wherein the analysing unit is configured to detect a wet spot on said floor area using said sampled air temperature sampled by the temperature sensor and said sampled air temperature sampled by the at least one further temperature sensor.

20. The vacuum cleaner device according to claim 18, wherein the analyzing unit is configured to determine a location and/or dimension of the wet spot using the sampled temperatures sampled by the temperature sensor and the at least one further temperature sensor.

* * * * *